US010474090B2

(12) United States Patent
Ichiyanagi et al.

(10) Patent No.: US 10,474,090 B2
(45) Date of Patent: Nov. 12, 2019

(54) IMAGE FORMING APPARATUS

(71) Applicant: Brother Kogyo Kabushiki Kaisha, Nagoya-shi, Aichi-ken (JP)

(72) Inventors: Masao Ichiyanagi, Ama (JP); Takeshi Yamanaka, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 72 days.

(21) Appl. No.: 15/715,883

(22) Filed: Sep. 26, 2017

(65) Prior Publication Data

US 2018/0095409 A1 Apr. 5, 2018

(30) Foreign Application Priority Data

Sep. 30, 2016 (JP) ..... 2016-194401

(51) Int. Cl.
*G03G 21/16* (2006.01)
*G03G 15/00* (2006.01)
*G03G 15/23* (2006.01)

(52) U.S. Cl.
CPC ..... *G03G 21/1638* (2013.01); *G03G 15/234* (2013.01); *G03G 15/6576* (2013.01); *G03G 21/1647* (2013.01); *G03G 21/1633* (2013.01); *G03G 2215/00438* (2013.01)

(58) Field of Classification Search
CPC ..... G03G 21/1638
USPC ..... 399/401
See application file for complete search history.

(56) References Cited

U.S. PATENT DOCUMENTS 4,884,110 A * 11/1989 Tsurubuchi ..... B65H 15/00 399/402
8,447,223 B2 5/2013 Inui
8,613,443 B2 * 12/2013 Matsumoto ..... B65H 85/00 271/225
2004/0190964 A1 * 9/2004 Kimizuka ..... B65H 9/166 399/401
2007/0273092 A1 * 11/2007 Inui ..... B65H 9/166 271/251
2008/0296834 A1 * 12/2008 Matsubara ..... B65H 29/58 271/225
2009/0110457 A1 4/2009 Inui
(Continued)

FOREIGN PATENT DOCUMENTS

JP 2006248618 A 9/2006
JP 2009107828 A 5/2009
JP 2015086047 A 5/2015

*Primary Examiner* — Anthony H Nguyen
(74) *Attorney, Agent, or Firm* — Banner & Witcoff, Ltd.

(57) ABSTRACT

An image forming apparatus includes an image forming device, a switchback roller, and a re-conveying device. The re-conveying device includes a guide configured to change a conveying direction of a sheet conveyed by the switchback roller from a vertical direction to a horizontal direction and to guide the sheet in a width direction. The guide has a first guide surface and a second guide surface. The first guide surface and the second guide surface define a conveying path therebetween. The second guide surface is located closer to a center of a curvature of the conveying path than the first guide surface in a radial direction of the curvature. The first guide surface has a first area being planar and a second area downstream of the first area. The first area is configured to be contacted by a leading end of the sheet.

7 Claims, 6 Drawing Sheets

(56) References Cited

U.S. PATENT DOCUMENTS

| | | | | |
|---|---|---|---|---|
| 2013/0045036 | A1* | 2/2013 | Iino | G03G 15/234 399/401 |
| 2013/0236226 | A1* | 9/2013 | Funayama | G03G 15/0189 399/364 |
| 2014/0177012 | A1* | 6/2014 | Kubo | H04N 1/123 358/474 |
| 2016/0116881 | A1* | 4/2016 | Kodama | B65H 43/00 358/498 |

* cited by examiner

IMAGE FORMING APPARATUS

CROSS-REFERENCE TO RELATED APPLICATION

This application claims priority from Japanese Patent Application No. 2016-194401 filed on Sep. 30, 2016, the content of which is incorporated herein by reference in its entirety.

FIELD OF DISCLOSURE

The present disclosure relates to an image forming apparatus.

BACKGROUND

A known image forming apparatus that can perform double-sided printing includes an image forming device and a reverse path through which a sheet that has passed through the image forming device is re-conveyed to it. On the reverse path, a side registration guide is provided that changes a conveying direction, in which the sheet is conveyed, from vertical to horizontal, and also guides the sheet while correctly keeping the position of the sheet in its width direction.

The side registration guide has two guide surfaces. When the sheet passes between these guide surfaces, the conveying direction of the sheet is changed. The side registration guide also has a side wall that is contacted by one end of the sheet in the width direction. Since the side wall is inclined relative to the conveying direction of the sheet, the sheet is guided and its position in the width direction is correctly kept. The width direction is a direction orthogonal to the conveying direction of the sheet (that is, the scanning direction) and to the thickness direction of the sheet.

SUMMARY

If the sheet comes into contact with the side registration guide in a state in which the sheet deviates in its width direction or is curled, a paper fold or paper jam is likely to occur.

In view of the above problem, an object of one aspect of the present disclosure is to provide an image forming apparatus that reduces a paper fold at the leading edge of a sheet and a paper jam from occurring at a guide.

According to an aspect of the disclosure, an image forming apparatus includes an image forming device, a switchback roller, and a re-conveying device. The image forming device is configured to form an image on a sheet. The switchback roller is disposed downstream of the image forming device and configured to reverse a conveying direction in which the sheet having the image thereon is conveyed such that the sheet is conveyed toward the image forming device. The re-conveying device is configured to re-convey the sheet toward the image forming device. The re-conveying device includes a guide. The guide is configured to change a conveying direction of the sheet conveyed by the switchback roller from a vertical direction to a horizontal direction and to guide the sheet in a width direction perpendicular to the vertical direction and the horizontal direction. The guide has a first guide surface and a second guide surface facing the first guide surface. The first guide surface and the second guide surface define a conveying path therebetween. The second guide surface is located closer to a center of a curvature of the conveying path than the first guide surface in a radial direction of the curvature. The first guide surface has a first area being planar and a second area downstream of the first area in the conveying direction. The first area of the first guide surface is configured to be contacted by a leading end of the sheet.

A leading edge of a sheet comes into contact with the first area being planar. A contact angle between the first area of the first guide surface and a leading edge of a sheet is kept substantially constant regardless of the position at which the sheet comes into contact with the first area. A space in which a leading edge of a sheet in contact with the first guide surface can potentially be folded is reduced. Even if a sheet is shifted away from the guide in a width direction or a sheet is curled, the leading edge of the sheet is less likely to be folded. As a result, a paper jam is eliminated or reduced.

BRIEF DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Figure 1:
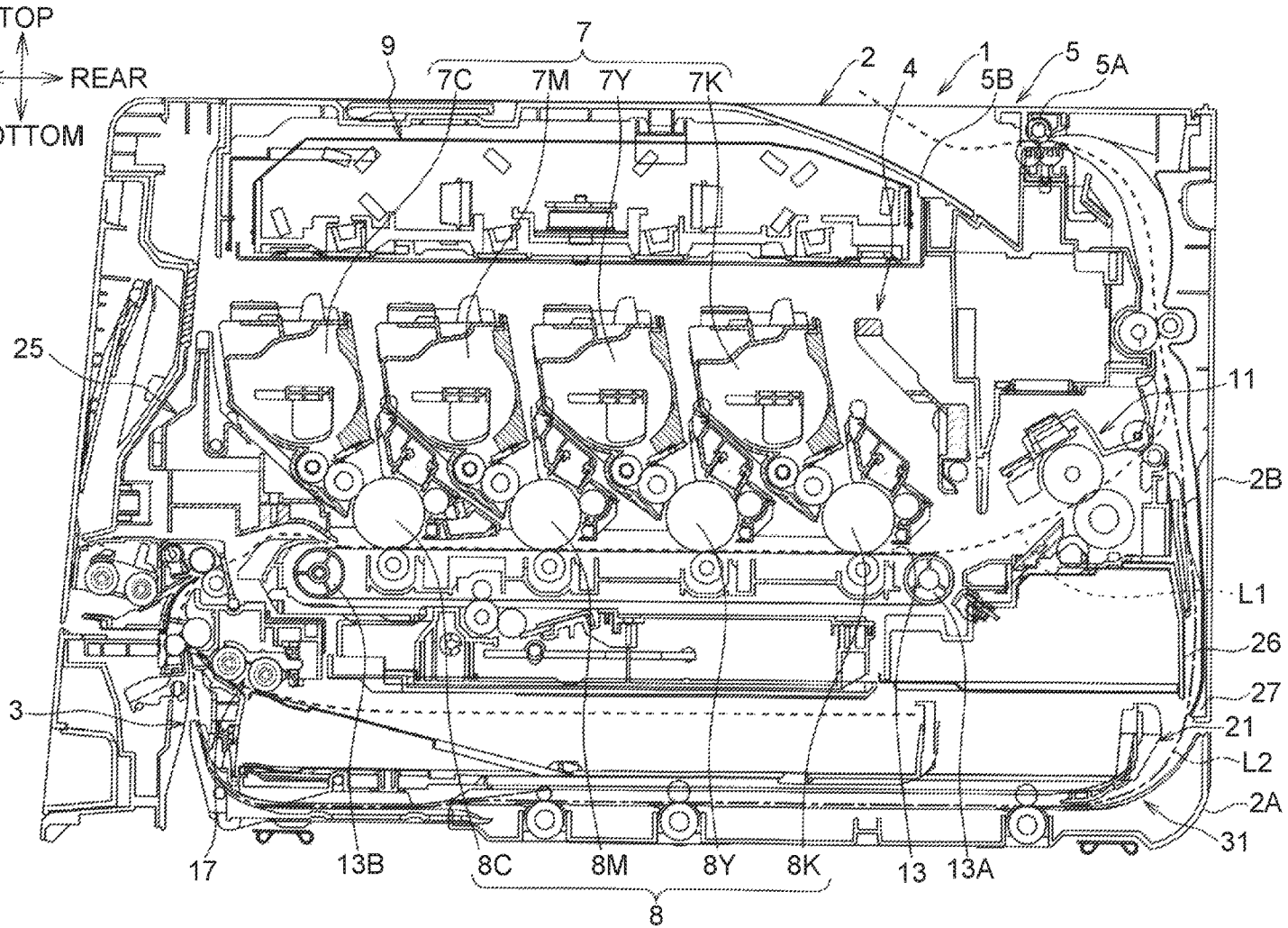
FIG. 1 is a central cross-sectional view of an image forming apparatus according an embodiment.

An embodiment, described below, of the present disclosure is only an example of an embodiment. Matters specifying the claimed invention described in the scope of the invention are not limited to specific means, structures, and the like indicated in the embodiments below.

In this embodiment, the present disclosure is applied to a color image forming apparatus. For easy understanding, mutual relationships among drawings, arrows and the like are indicated on these drawings to indicate directions. The present disclosure is not limited to the directions indicated on each drawing.

For a member or part that will be described below with at least a reference numeral or reference characters assigned, the number of members or parts provided is one except a case in which "a plurality of" or "two or more" is described. An embodiment of the present disclosure will be described below with reference to the drawings.

1. Overview of the Image Forming Apparatus

As illustrated in FIG. 1, an image forming apparatus 1 includes a sheet feed device 3, an image forming device 4, a sheet ejection device 5, and a sheet re-conveying device 31, which are all disposed in a housing 2.

The sheet feed device 3 has a sheet tray 21 that stores sheets, and also has a feed roller 17 that feeds out sheets from the sheet tray 21 toward the image forming device 4.

The image forming device 4, which is a so-called an electrophotographic image forming apparatus, forms an image on a sheet conveyed from the sheet feed device 3.

The sheet ejection device 5 has a sheet ejection tray 5B to which the sheet on which an image has been formed by the image forming device 4 is ejected, and also has a switchback roller 5A that has a function to eject a sheet to the sheet ejection tray 5B and a function to reverse the conveying direction of the sheet being ejected to the sheet ejection tray 5B and then feed the sheet toward the image forming device 4.

Figure 2:
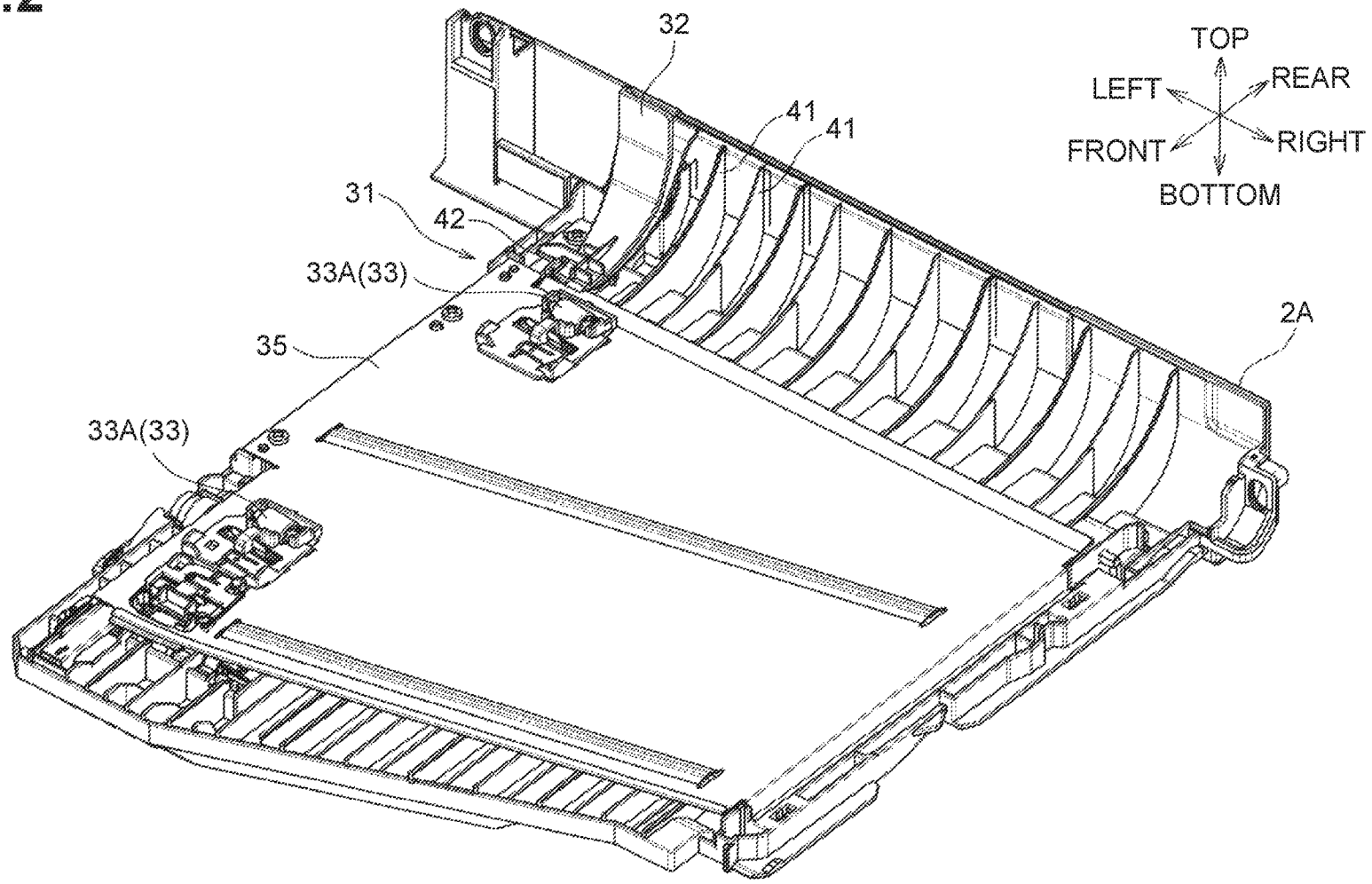
FIG. 2 is a perspective view of a lower frame included in the image forming apparatus in FIG. 1.
Figure 3:
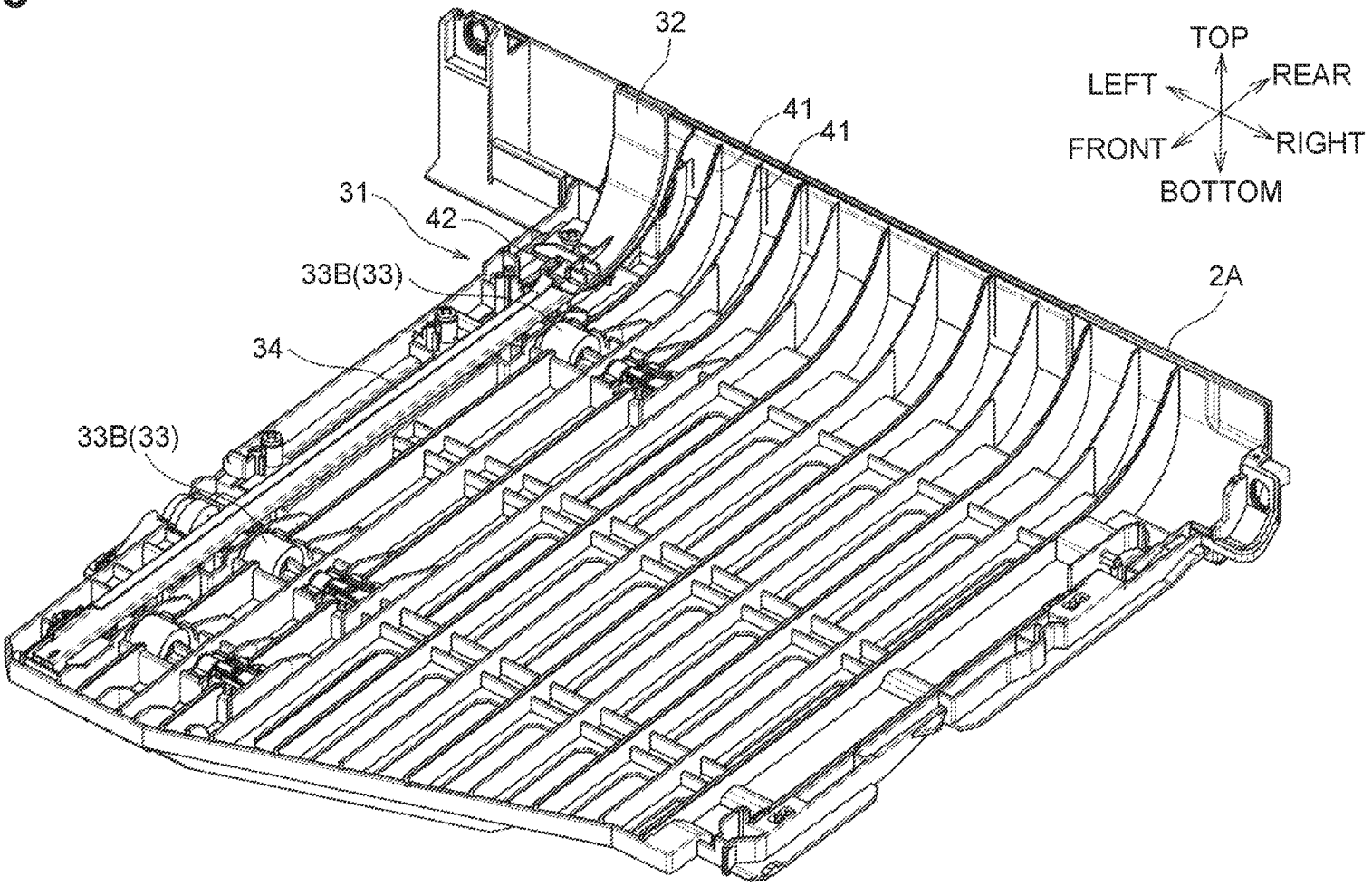
FIG. 3 is a perspective view of the lower frame of the image forming apparatus from which a plate and the upper rollers of conveying rollers, which are illustrated in FIG. 2, are omitted for brevity.

As illustrated in FIGS. 2 and 3, the sheet re-conveying device 31 has a side registration guide 32 configured to change the conveying direction of the sheet re-conveyed by the switchback roller 5A from vertical to horizontal and to guide the sheet in its width direction, one or a plurality of conveying rollers 33 disposed downstream of the guide 32 in the conveying direction, and a guide plate 34 that is contacted by a side edge of the re-conveyed sheet. In FIG. 3, the plate 35 and the upper roller of the conveying rollers 33 illustrated in FIG. 2 are eliminated.

As illustrated in FIG. 1, the image forming device 4 is accommodated in the housing 2 of the image forming apparatus 1. The image forming device 4 includes a developing unit 7, a photosensitive unit 8, an exposing unit 9, and a fixing unit 11. In correspondence to, for example, cyan, magenta, yellow, and black, the developing unit 7 has a plurality of developing cartridges 7C, 7M, 7Y, and 7K. Similarly, the photosensitive unit 8 has a plurality of photosensitive drums 8C, 8M, 8Y, and 8K in correspondence to cyan, magenta, yellow, and black. The developing unit 7 and photosensitive unit 8 are mounted in a drum unit 25.

A sheet on which to form an image is conveyed toward the fixing unit 11 by a belt 13. The belt 13, which is an endless belt in a band shape, turns while being stretched by rollers 13A and 13B spaced apart from each other.

The image forming apparatus 1 is configured to form images on both sides of a sheet. Specifically, the image forming apparatus 1 has a first conveying path L1 used to convey a sheet having an image that has been printed on one surface and a second conveying path L2 used to further form an image on the other surface of the sheet having the image printed on the one surface.

The sheet tray 21, which is disposed vertically below the drum unit 25, is a stacker on which many sheets can be stacked. The sheet tray 21 according to this embodiment is removably attached to the main body of the image forming apparatus 1. The sheet tray 21 may be a stack of a plurality of trays; different types of sheets may be stacked on different trays.

Here, the main body of the image forming apparatus 1 is a portion including the housing 2, a pair of main frames (not illustrated), and the like that are not disassembled by the user. The main frames are substantially plate-like reinforced members between which the image forming device 4 and the like are incorporated. The frames are disposed on respective sides of the drum unit 25 relative to the axial directions of the photosensitive drums 8C, 8M, 8Y, and 8K of the photosensitive unit 8.

The switchback roller 5A has not only a function to eject a sheet on which an image is formed as described above to the sheet ejection tray 5B but also a function to reverse the conveying direction of a sheet having an image formed on one surface and then feed or convey the sheet toward the image forming device 4.

The sheet switched back by the switchback roller 5A is moved to the sheet re-conveying device 31 disposed vertically below the sheet tray 21 and is then re-conveyed to the image forming device 4 by the sheet re-conveying device 31.

In the housing 2, a low-voltage power supply unit 26 is disposed below the fixing unit 11 and above the rear end of the sheet tray 21. The low-voltage power supply unit 26 drives the image forming apparatus 1.

2. Sheet Re-conveying Unit

As illustrated in FIGS. 2 and 3, the sheet re-conveying device 31 has the guide 32, the conveying rollers 33, and a guide plate 34.

The guide 32 is attached to the lower frame 2A of the housing 2 and is positioned below and in front of a rear cover 2B. The lower frame 2A is disposed below the sheet tray 21, constituting the bottom surface of the housing 2. The lower frame 2A has a plurality of guide ribs 41 and a guide fixing portion 42. The lower frame 2A has an inner surface that is curved vertically upward at a rear end portion of the lower frame 2A, that is, an end portion to which a sheet is re-conveyed by the switchback roller 5A.

The guide ribs 41 are located at the rear end portion of the lower frame 2A, and each shaped like a ridge extending vertically upward from the inner surface of the lower frame 2A and in parallel to the conveying direction of a sheet. The upper ends of the guide ribs 41 are more curved upward at more backward positions.

The guide fixing portion 42, which fixes the guide 32, is disposed at a rear left end portion of the lower frame 2A. The guide fixing portion 42 is positioned to the left of the guide ribs 41. The guide fixing portion 42 has a plurality of attachment ribs and a cylindrical screwed portion protruding vertically upward. "Left" in this embodiment indicates a horizontal direction that is parallel to the axial directions of the photosensitive drums 8C, 8M, 8Y, and 8K of the photosensitive unit 8 and is on the left side relative to a direction from the front side to the rear side.

The rear cover 2B is a substantially flat-plate-like member that constitutes a side surface of the housing 2 on the rear side. The rear cover 2B has a curved portion 27 at the bottom, the curved portion 27 being curved and protruding from the rear cover 2B toward the front side (that is, the inner side of the housing 2).

Figure 5A:
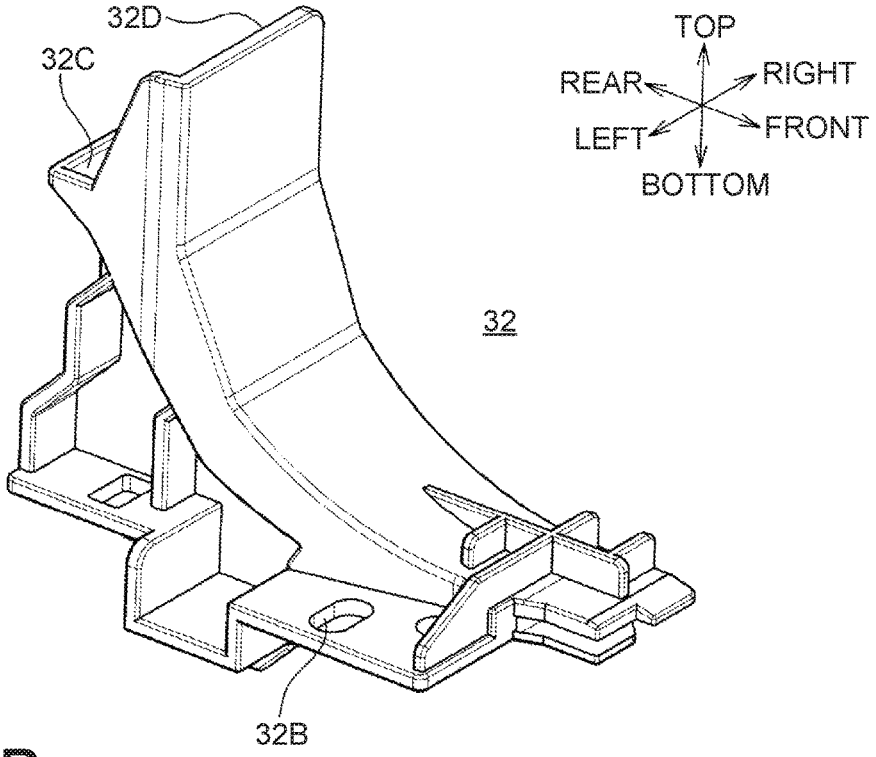
FIG. 5A is a perspective view of the guide in FIG. 4 when viewed from the front left.
Figure 5B:
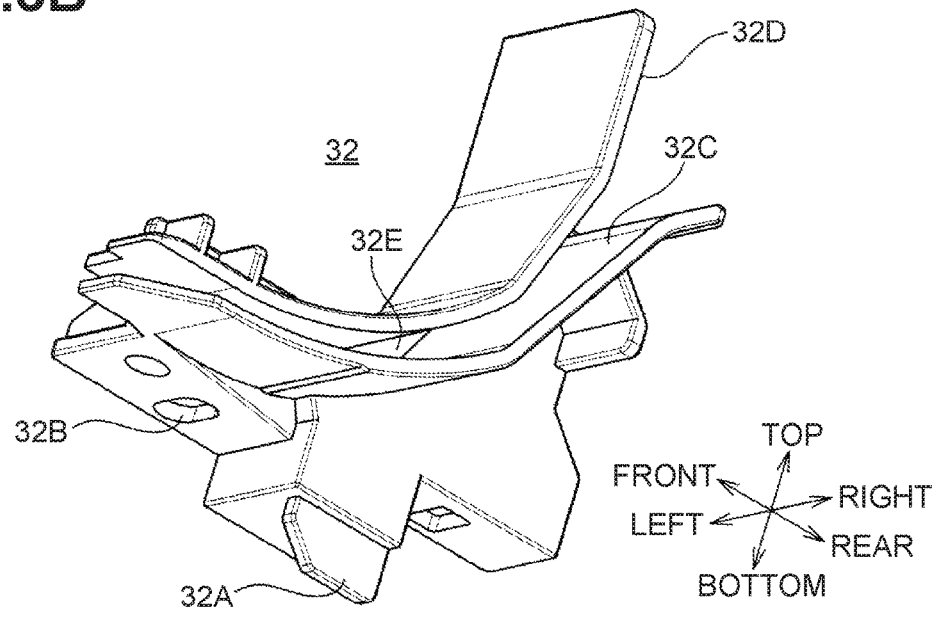
FIG. 5B is another perspective view of the guide when viewed from below on the right side.

As illustrated in FIGS. 5A and 5B, the guide 32 has an engaging rib 32A and a screw insertion hole 32B at its lower left portion. The engaging rib 32A is shaped like a flat plate that protrudes in the downward direction of the guide 32 and extends in the front-rear direction. The engaging rib 32A is structured to fit between attachment ribs of the guide fixing portion 42 of the lower frame 2A.

The screw insertion hole 32B is formed in front of the engaging rib 32A. The screw insertion hole 32B is an elliptical through-hole; and its longer axis is parallel to the left-and-right direction. In a state in which the engaging rib 32A is fitted between the attachment ribs of the guide fixing portion 42 of the lower frame 2A, when a screw is passed through the screw insertion hole 32B and is then screwed into the screwed portion formed in the guide fixing portion 42, the guide 32 is fixed to the lower frame 2A. The position of the guide 32 can be adjusted in the width direction within a range determined by the longer axis of the screw insertion hole 32B.

As illustrated in FIG. 5A, the guide 32 has a first guide surface 32C facing one surface of a sheet to be conveyed, a second guide surface 32D facing the other surface of the sheet, and a third guide surface 32E that is contacted by a side edge of the sheet.

Figure 4:
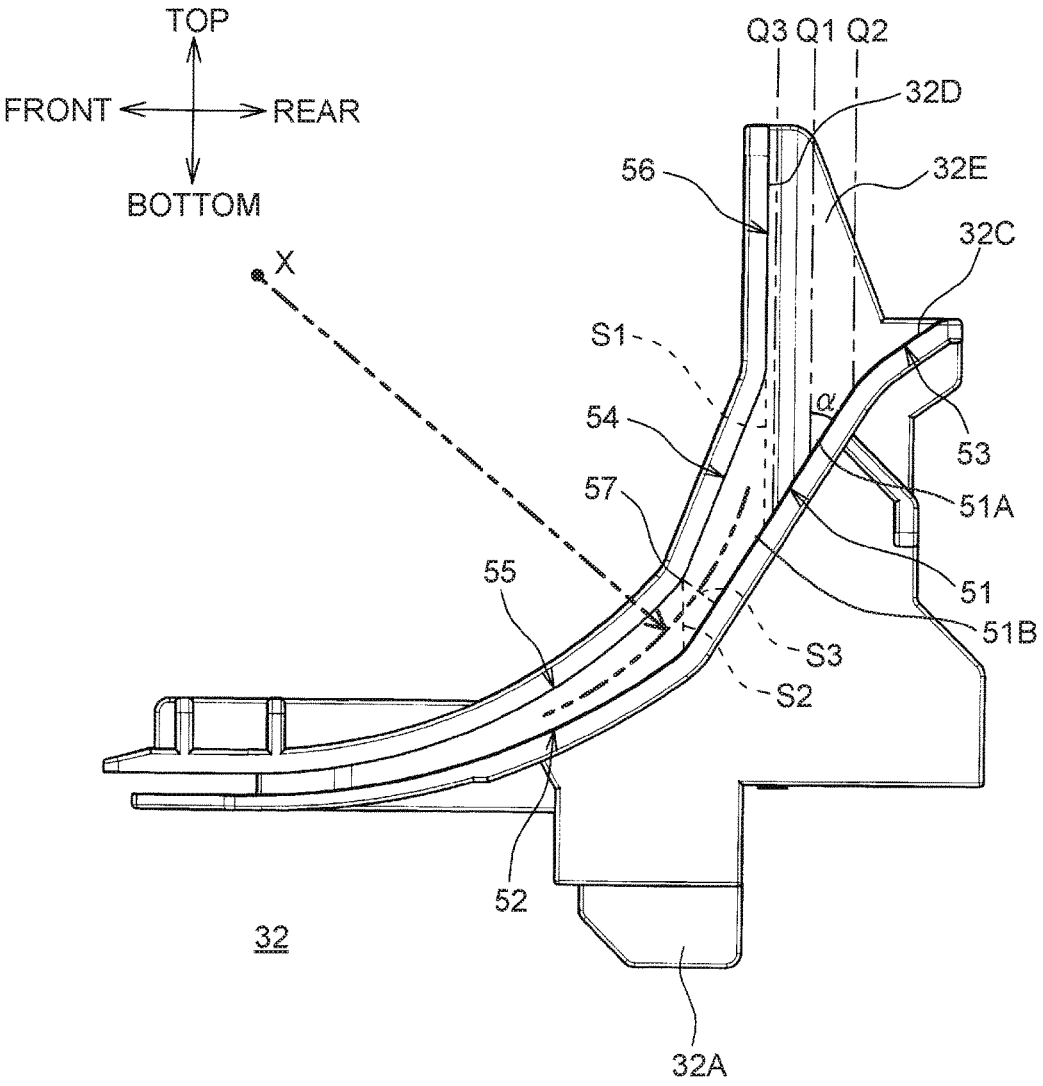
FIG. 4 is a side view of a guide included in the image forming apparatus in FIG. 1.

As illustrated in FIG. 4, the guide 32 has a turnover path (as an example of a conveying path) defined by the first guide surface 32C, second guide surface 32D, and third guide surface 32E. The turnover path has an inlet opening that is defined by the first guide surface 32C, second guide surface 32D, and third guide surface 32E and is vertically open, and also has an outlet opening that is defined by these guide surfaces and is horizontally open. The guide 32 does not have a surface facing the third guide surface 32E in a horizontal direction in a range from the inlet opening to the outlet opening, but is open on the right side. Therefore, the inlet opening and outlet opening of the guide 32 have no edge facing the third guide surface 32E.

When a sheet is conveyed through the turnover path, the conveying direction of the sheet is changed from vertical to horizontal. Specifically, when a sheet that has been switched back enters the inlet opening of the turnover path, which is open in the vertical direction of the turnover path, the sheet is guided along the first guide surface 32C and third guide surface 32E. While the sheet is guided along the first guide surface 32C and the third guide surface 32E, the sheet gradually changes its direction of progress along the first guide surface 32C and is ejected from the outlet opening, which is horizontally open.

As illustrated in FIG. 4, at least a portion of the turnover path is curved. The curved portion of the turnover path, which is indicated by a dotted line between the first guide surface 32C and the second guide surface 32D, has a center X of curvature and a radius of curvature. The second guide surface 32D is positioned closer to the center X (that is, the interior of the housing 2) of the curvature of the curved portion of the turnover path than the first guide surface 32C is, in a radial direction of the curvature.

As illustrated in FIGS. 4, 5A, and 5B, the first guide surface 32C is structured to be parallel to the width direction (that is, the left-and-right direction indicated in FIGS. 5A and 5B) and curved or bent vertically upward from the front side toward the rear side. Specifically, as illustrated in FIG. 4, the first guide surface 32C has a first area 51 formed as a planar surface, a second area 52 disposed downstream of the first area 51 in the conveying direction, and a third area 53 disposed upstream of the first area 51 in the conveying direction.

The first area 51 included in the first guide surface 32C is an area to be contacted by the leading edge of a sheet vertically conveyed from above by the switchback roller 5A. To allow for variations in the position of the leading edge of the sheet that enters the guide 32, the first area 51 has a certain width in the front-rear direction, that is, the conveying direction.

The first area 51 included in the first guide surface 32C includes an upstream area 51A located on the upstream side in the conveying direction relative to a first plane 51 extending vertically downward from an end of the second guide surface 32D at the inlet opening in the guide 32, and also includes a downstream area 51B located on the downstream side, the first plane S1 being a boundary between the upstream area 51A and the downstream area 51B. Both the upstream area 51A and the downstream area 51B are coplanar surfaces. The downstream area 51B extends to a second plane S2 extending vertically downward from a bent portion 57 formed as part of the second guide surface 32D. As illustrated in FIG. 4, when a sheet is conveyed vertically downward from above along the first plane S1, the leading edge of the sheet comes into contact with the upstream area 51A in the first area 51 included in the first guide surface 32C. The sheet may enter the guide 32 from a central position Q1 in the inlet opening in the guide 32 in the front-rear direction, may enter the guide 32 from a rear position Q2, or may enter the guide 32 from a front position Q3. The leading edge of a sheet does not come into contact with the first guide surface 32C at a fixed position, but may come into contact with the first area 51 included in the first guide surface 32C at any position.

In addition, when a sheet enters the inlet opening in the guide 32 in a state in which the sheet is inclined relative to the vertical direction, the sheet may come into contact with the downstream area 51B in the first area 51 included in the first guide surface 32C.

When a third plane S3 perpendicular to the first guide surface 32C is drawn from the bent portion 57 included in the second guide surface 32D to the first guide surface 32C, the third plane S3 reaches the downstream area 51B in the first area 51 included in the first guide surface 32C. The distance between a first area 54 included in the second guide surface 32D and the first area 51 included in the first guide surface 32C is gradually reduced toward the outlet opening. At a position at which the third plane S3 crosses the second guide surface 32D and first guide surface 32C, the distance becomes a minimum. This structure restricts the sheet from moving in its thickness direction.

The second area 52 included in the first guide surface 32C is disposed downstream of the first area 51 in the conveying direction. The second area 52 is continuous with the first area 51. The second area 52 is less inclined relative to a horizontal direction than the first area 51. When a sheet enters the guide 32, its conveying direction is changed to a horizontal direction mainly in the second area 52. To do so, the second area 52 is formed as a curved surface that is concave in the radial direction from the center X of the curvature (that is, toward the exterior of the housing 2).

Specifically, the vertical height (that is, the vertical distance from the bottom of the lower frame 2A) of the second area 52 is gradually reduced from the upstream side in the conveying direction toward the downstream side. That is, the inclination angle formed by the normal relative to a horizontal direction is gradually reduced. A portion at which the second area 52 and first area 51 are connected together may be bent, but it is preferable for these areas to be smoothly connected together.

The third area 53 included in the first guide surface 32C is located on the upstream side of the first area 51 in the conveying direction. The third area 53 is less inclined relative to a horizontal direction than the first area 51. The third area 53 may be a plane or may be a curved surface.

The whole of the third area 53 is included in an imaginary opening formed by projecting the inlet opening in the guide 32 to an imaginary horizontal plane. That is, the whole of the third area 53 is exposed from the inlet opening in the guide 32. A portion at which the third area 53 and first area 51 are connected together may be bent, but it is preferable for these areas to be smoothly connected together.

The rear end of the first guide surface 32C (that is, the rear end of the third area 53) is located below and behind a front end of the curved portion 27 (FIG. 1) of the rear cover 2B. Specifically, the first guide surface 32C and curved portion 27 are disposed so that, when they are projected to an imaginary horizontal plane, they partially overlap.

The length of the first guide surface 32C in the conveying direction, the inclination angle formed by each area relative to a horizontal direction, the radius of curvature of the turnover path in each area, and the like are appropriately designed so that the conveying direction of a sheet is gradually changed from vertical to horizontal.

As illustrated in FIGS. 4, 5A, and 5B, the second guide surface 32D is structured to be parallel to the width direction and to be curved or bent upward from the front side toward the rear side. The second guide surface 32D has the first area 54 that mainly faces the first area 51 included in the first guide surface 32C, a second area 55 that mainly faces the second area 52 included in the first guide surface 32C, and a third area 56 that forms the inlet opening in the guide 32. The second guide surface 32D also has the bent portion 57 as a portion at which the first area 54 and second area 55 are connected together. The bent portion 57 is bent or convex toward the first guide surface 32C in the radial direction of the curvature of the turnover path.

When a sheet is conveyed vertically downward from above by the switchback roller 5A and the leading edge of the sheet comes into contact with the first area 51 included in the first guide surface 32C, the movement of the sheet in its thickness direction is restricted between the first area 51 included in the first guide surface 32C and the first area 54 included in the second guide surface 32D. The first area 54 included in the second guide surface 32D may be a plane or may be a curved surface. Since, in this embodiment, the first area 51 included in the first guide surface 32C is a plane, however, it is preferable for the first area 54 included in the second guide surface 32D to be also a plane.

Figure 6:
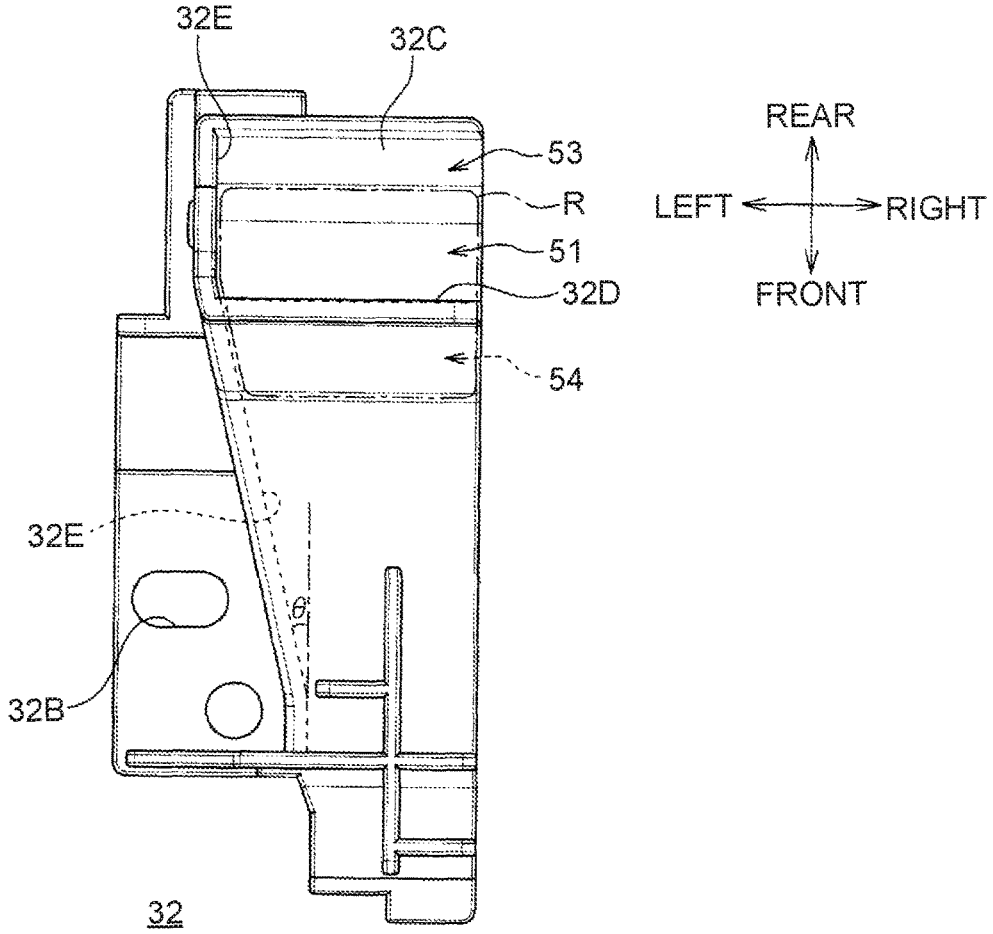
FIG. 6 is a plan view of the guide in FIG. 4.

In a plan view as illustrated in FIG. 6, the whole of the first area 54 included in the second guide surface 32D is included in an imaginary area R formed by projecting the first area 51 included in the first guide surface 32C to an imaginary horizontal plane. That is, the length of the first area 54 included in the second guide surface 32D in the front-rear direction is shorter than the length of the first area 51 included in the first guide surface 32C in the front-rear direction.

The inclination angle formed by the first area 54 included in the second guide surface 32D relative to a horizontal direction is larger than the inclination angle formed by the first area 51 included in the first guide surface 32C relative to a horizontal direction. Therefore, the vertical distance between the first area 51 included in the first guide surface 32C and the first area 54 included in the second guide surface 32D is gradually reduced toward the downstream side in the conveying direction.

The second area 55 included in the second guide surface 32D and the second area 52 included in the first guide surface 32C change the conveying direction of a sheet from vertical to horizontal. Therefore, the second area 55 included in the second guide surface 32D is preferably formed as a curved surface that is convex in the radial direction from the center X of the curvature of the turnover path.

The inclination angle formed by the tangent line of the second area 55 included in the second guide surface 32D relative to a horizontal direction is larger than the inclination angle formed by the tangent line of the second area 52 included in the first guide surface 32C relative to the horizontal direction at the same position in the front-rear direction. That is, the vertical distance between the second area 52 included in the first guide surface 32C and second area 55 included in the second guide surface 32D is also gradually reduced toward the downstream side in the conveying direction.

The bent portion 57 is located on the boundary between the second area 55 included in the second guide surface 32D and the first area 54 included in the second guide surface 32D. To smoothly convey a sheet, it is preferable for the second area 55 and first area 54 included in the second guide surface 32D to be smoothly connected together.

The third area 56 included in the second guide surface 32D forms the inlet opening in the guide 32. To assure that the entrance of a sheet into the guide 32 is not impeded, the third area 56 included in the second guide surface 32D is preferably a plane that vertically extends as illustrated in FIG. 4.

The third area 56 included in the second guide surface 32D may be inclined forward or backward relative to the vertical direction or may be curved. In this case, the starting point of the first plane S1 (that is, the end of the second guide surface 32D at the inlet opening) is the rearmost end of the third area 56 included in the second guide surface 32D. If, for example, the third area 56 included in the second guide surface 32D is inclined forward relative to a portion at which the third area 56 and first area 54 are connected together, the starting point of the first plane S1 is the lowest portion of the third area 56, that is, the portion at which the third area 56 and first area 54 are connected together.

The third area 56 included in the second guide surface 32D is disposed upstream of the first area 54 included in the second guide surface 32D in the conveying direction. The third area 56 is continuous with the first area 54. To smoothly convey a sheet, it is preferable for the third area 56 and first area 54 included in the second guide surface 32D to be smoothly connected together.

The third area 56 included in the second guide surface 32D is located ahead of the front end of the curved portion 27 (FIG. 1) of the rear cover 2B. Specifically, the curved portion 27 and the third area 56 included in the second guide surface 32D are disposed so that, when they are projected to an imaginary vertical plane, they at least partially overlap.

As illustrated in FIGS. 4 and 6, the third guide surface 32E connects the left end of the first guide surface 32C and the left end of the second guide surface 32D together, and extends vertically.

As illustrated in FIG. 4, the third guide surface 32E extends to a downstream side of the guide 32 in the conveying direction beyond the first area 51 included in the first guide surface 32C. As illustrated in FIG. 6, the third guide surface 32E is a planar surface inclined relative to the conveying direction of a sheet. When a sheet enters the guide 32, the sheet is moved along the inclined plane while the left edge of the sheet is kept in contact with the third guide surface 32E. Therefore, the entire sheet is guided toward the right. With this structure, the position of the sheet in the width direction (that is, the left-and-right direction) is appropriately determined. The inclination angle θ formed by the third guide surface 32E relative to the conveying direction is preferably 15 degrees or less. If the inclination angle θ exceeds 15 degrees, the leading edge of the sheet is likely to be folded and thereby a paper jam is likely to occur.

As illustrated in FIG. 4, the inlet-side edge of the third guide surface 32E is composed of a first horizontal area that extends horizontally from the upper end of the second guide surface 32D, an inclined area that is contiguous to the first horizontal area and extends backward and downward, and a second horizontal area that is contiguous to the inclined area and extends horizontally to the upper end of the first guide surface 32C.

In this embodiment, the first guide surface 32C, second guide surface 32D, and third guide surface 32E are each a surface of a plate-like member.

As illustrated in FIGS. 2 and 3, each conveying roller set 33 is composed of a lower roller 33B and an upper roller 33A that are disposed downstream of the guide 32 in the conveying direction and at a left portion of the lower frame 2A; the lower roller 33B makes contact with one surface of a sheet from below, and the upper roller 33A makes contact with the other surface of the sheet from above. As illustrated in FIG. 2, the upper roller 33A is disposed on a plate 35 located between the lower frame 2A and the sheet tray 21. The rotational axis of the upper roller 33A of the conveying roller set 33 is inclined relative to the right-and-left direction and the conveying direction. That is, the upper roller 33A is disposed so as to be oriented in a direction in which a passing sheet is guided toward the left.

The re-conveying device 31 has a plurality of, e.g., two, in this embodiment, conveying roller sets 33 arranged along the conveying direction.

The guide plate 34 is disposed downstream of the guide 32 in the conveying direction, at the left portion of the lower frame 2A, and to the left of the conveying roller sets 33. After a sheet has passed through the guide 32, the conveying roller sets 33 guide the sheet toward the left. Therefore, the sheet is conveyed while its left edge is kept in contact with the guide plate 34.

3. Sheet Conveying Path

After a sheet has been supplied from the sheet tray 21, an image is first formed on one surface of the sheet through the first conveying path L1. The first conveying path L1 includes a path extending forward and upward from the sheet tray 21, a path through which the sheet is conveyed rearward by the belt 13 while an image is being formed on the sheet by the image forming device 4, a path extending upward from the rear end of the belt 13, and a path through which the sheet is ejected to the sheet ejection tray 5B by the switchback roller 5A.

After an image has been formed on the one surface of the sheet, another image is formed on the other surface of the sheet as well through the second conveying path L2. The second conveying path L2 includes a path through which the sheet is switched back downward from the sheet ejection tray 5B by the switchback roller 5A, a path (turnover path) through which the conveying direction is changed from vertical to horizontal as a result of the sheet passing through the guide 32, a path extending forward between the lower frame 2A and the plate 35, and a path through which the sheet is conveyed forward and upward toward the belt 13 again.

The second conveying path L2 further includes a path through which the sheet is conveyed rearward by the belt 13 while an image is being formed on the sheet by the image forming device 4, a path extending upward from the rear end of the belt 13, and a path through which the sheet is ejected to the sheet ejection tray 5B by the switchback roller 5A; these paths are common to part of the first conveying path L1. While a sheet is being conveyed through the first conveying path L1 and second conveying path L2, images are formed on both sides of the sheet, and the sheet on which the images have been formed is ejected to the sheet ejection tray 5B.

When the sheet is conveyed through the second conveying path L2 by the switchback roller 5A, the sheet passes vertically between the rear cover 2B of the housing 2 and the low-voltage power supply unit 26 and enters the inlet opening in the guide 32 while being guided by the curved portion 27 of the rear cover 2B. After the sheet has entered the guide 32, the leading edge of the sheet comes into contact with the first area 51 included in the first guide surface 32C.

The sheet is then moved while being guided by the first guide surface 32C and second guide surface 32D. During this movement, the conveying direction is changed from vertical to horizontal. When the sheet passes through the guide 32, a side edge of the sheet comes into contact with the third guide surface 32E, so the sheet is conveyed while being guided in the width direction.

After having passed through the guide 32, the sheet is conveyed forward by the conveying roller sets 33. Then, the sheet is moved forward and upward and joins the first conveying path L1, through which the sheet is re-conveyed to the image forming device 4. Thus, images are printed on both sides of the sheet. In one-sided printing, after the sheet has passed through the first conveying path L1 and has been ejected to the sheet ejection tray 5B through the first conveying path L1, the sheet is not conveyed to the second conveying path L2.

4. Characteristics of the Image Forming Apparatus According to this Embodiment

This embodiment illustrates that that the sheet re-conveying device 31 has the guide 32 having a shape as descried above. Specifically, the first guide surface 32C of the guide 32 has the first area 51, which is a plane and is contacted by the leading edge of a sheet, and also has the second area 52 disposed downstream of the first area 51 in the conveying direction.

In general, if a sheet that enters the guide 32 is shifted away from the guide 32 in the width direction, the guide 32 needs to be positioned toward an end of the lower frame 2A in the width direction (that is, toward the left end of the lower frame 2A in this embodiment) to prevent, in the guide 32, the leading edge of the sheet from being folded or the sheet from jamming. When the guide 32 is positioned toward the end of the lower frame 2A in the width direction, if the distance between the guide 32 and the conveying roller set 33 disposed downstream of the guide 32 in the conveying direction is increased, the leading edge of the sheet is not easily folded because the inclination angle θ formed by the third guide surface 32E remains unchanged.

If the distance between the guide 32 and the conveying roller 33 cannot be increased due to a limitation to the space in the image forming apparatus 1, the inclination angle θ formed by the third guide surface 32E needs to be increased. If, however, the inclination angle θ formed by the third guide surface 32E is increased, the leading edge of a sheet is likely to be folded and a paper jam is likely to occur.

If the first area 51 included in the first guide surface 32C is curved, a contact angle α between the first guide surface 32C and the leading edge of the sheet varies depending on the position at which the sheet comes into contact with the first guide surface 32C. If the contact angle α is large, the leading edge of the sheet is likely to be folded and a paper jam is thereby likely to occur. In this embodiment, however, the sheet comes into contact with the first area 51, which is a plane inclined at a fixed angle relative to the conveying direction of the sheet, the contact angle α between the first guide surface 32C and the leading edge of the sheet is kept substantially constant regardless of the position at which the sheet comes into contact with the first guide surface 32C. Therefore, the leading edge of the sheet is less likely to be folded and a paper jam can be effectively eliminated or reduced.

Furthermore, in this embodiment, the first area 51 included in the first guide surface 32C is a plane, so the distance between the first area 51 and the second guide surface 32D is reduced when compared with a case in which the first area 51 is curved. That is, since a space in which a sheet in contact with the first guide surface 32C can potentially be folded is reduced, even if the sheet is curled, the leading edge of the sheet is less likely to be folded. As a result, a paper jam is eliminated or reduced.

As a result, in this embodiment, it is possible to suppress a paper fold at the leading edge of a sheet and a paper jam during re-conveying, without having to increase the distance between the guide 32 and the conveying roller set 33 and the inclination angle θ formed by the third guide surface 32E.

In this embodiment, the first area 51 included in the first guide surface 32C includes the upstream area 51A located on the upstream side in the conveying direction relative to the first plane S1 extending vertically downward from an end of the second guide surface 32D at the inlet opening, which a sheet enters, in the guide 32, and also includes the downstream area 51B located on the downstream side, the first plane S1 being a boundary between the upstream area 51A and the downstream area 51B. The downstream area 51B extends to the second plane S2 extending vertically downward from the bent portion 57 of the second guide surface 32D. Therefore, the sheet comes into contact with the first guide surface 32C within the range of the upstream area 51A or downstream area 51B, which is a plane area included in the first guide surface 32C, regardless of the orientation of the sheet at a time when the sheet has entered the opening in the guide 32. Therefore, it is possible to prevent a paper fold at the leading edge of a sheet and a paper jam.

In this embodiment, the first area 51 included in the first guide surface 32C includes the downstream area 51B. The downstream area 51B extends to the second plane S2 extending vertically downward from the bent portion 57 of the second guide surface 32D. Therefore, the movement of the sheet in the thickness direction is restricted between the bent portion 57 and the downstream area 51B of the first area 51, so it is possible to effectively suppress the leading edge of the sheet from being folded.

In this embodiment, the guide 32 includes the third guide surface 32E, which is contacted by the left edge of the sheet and extends toward the downstream side in the conveying direction beyond the first area 51 included in the first guide surface 32C. Therefore, if a sheet enters the guide 32 in a state in which the sheet deviates toward the left in the left-and-right direction, the sheet can be guided toward the right, eliminating the positional deviation.

Other Embodiments

Although the first area 51 included in the first guide surface 32C according to the above embodiment includes an area located on the upstream side in the conveying direction relative to the first plane S1, the present disclosure is not limited to this. The first area 51 included in the first guide surface 32C only needs to include at least an area that is contacted by the leading edge of a sheet. Therefore, the first area 51 included in the first guide surface 32C does not necessarily have to include an area located on the upstream side in the conveying direction relative to the first plane S1.

Although the first area 51 included in the first guide surface 32C according to the above embodiment includes an area located on the downstream side in the conveying direction relative to the first plane S1 and on the upstream side in the conveying direction relative to the second plane S2, the present disclosure is not limited to this. The first area 51 included in the first guide surface 32C only needs to include at least an area that is contacted by the leading edge of a sheet, as described above. Therefore, the first area 51 included in the first guide surface 32C may not include an area located on the upstream side in the conveying direction relative to the second plane S2.

Although the third guide surface 32E according to the above embodiment extends toward the downstream side in the conveying direction beyond the first area 51 included in the first guide surface 32C, the present disclosure is not limited to this. The third guide surface 32E may not extend toward the downstream side in the conveying direction beyond the first area 51 included in the first guide surface 32C.

Although the third guide surface 32E according to the above embodiment is a planar surface inclined relative to the conveying direction of a sheet, the present disclosure is not limited to this. The third guide surface 32E may be a curved surface or a surface having a folding point.

Although the second area 52 included in the first guide surface 32C according to the above embodiment is a curved surface, the present disclosure is not limited to this. The second area 52 included in the first guide surface 32C may be a plane.

Although, in the above embodiment, the first guide surface 32C includes the third area 53, the present disclosure is not limited to this. The first guide surface 32C may not include the third area 53. By contrast, the first guide surface 32C may include an area other than the first area 51, second area 52, and third area 53.

Although, in the above embodiment, the second guide surface 32D includes the bent portion 57, the present disclosure is not limited to this. The second guide surface 32D may not include the bent portion 57. Furthermore, if the functions of the guide 32 are assured, each area included in the second guide surface 32D may be appropriately omitted or another area may be added to the second guide surface 32D.

Although, in the above embodiment, the sheet re-conveying device 31 includes the conveying roller sets 33 and guide plate 34 besides the guide 32, this structure can be changed to another structure having equivalent functions.

Although, in the above embodiment, the image forming apparatus 1 is a color image forming apparatus including a plurality of developing cartridges and a plurality of photosensitive drums, the present disclosure is not limited to this. The present disclosure can also be applied to a monochrome image forming apparatus.

If the present disclosure matches the intended scope of the present invention described in the claims of the present invention, the present disclosure is not limited to the embodiment described above.

What is claimed is:

1. An image forming apparatus comprising:

an image forming device configured to form an image on a sheet;

a switchback roller disposed downstream of the image forming device and configured to reverse a conveying direction in which the sheet having the image thereon is conveyed such that the sheet is conveyed toward the image forming device; and a re-conveying device configured to re-convey the sheet toward the image forming device, the re-conveying device including a guide, the guide being configured to change a conveying direction of the sheet conveyed by the switchback roller from a vertical direction to a horizontal direction and to guide the sheet in a width direction perpendicular to the vertical direction and the horizontal direction, wherein the guide has a first guide surface and a second guide surface facing the first guide surface, the first guide surface and the second guide surface defining a conveying path therebetween, wherein the second guide surface is located closer to a center of a curvature of the conveying path than the first guide surface in a radial direction of the curvature, and wherein the first guide surface has a first area that is planar and inclined at an angle greater than 0° relative to the vertical direction, and a second area downstream of the first area in the conveying direction, the first area of the first guide surface configured to be contacted by a leading end of the sheet.

2. The image forming apparatus according to claim 1, wherein the first area of the first guide surface includes an upstream area in the conveying direction relative to a plane extending downward from an end of the second guide surface in the vertical direction, the end of the second guide surface partially defining an opening in which the sheet enters the guide.

3. The image forming apparatus according to claim 2, wherein the second guide surface has a bent portion which is bent toward the first guide surface in the radial direction of the curvature of the conveying path, and wherein the first area of the first guide surface includes a downstream area extending to a plane extending downward from the bent portion in the vertical direction.

4. The image forming apparatus according to claim 1, wherein the guide has a third guide surface configured to be contacted by a side edge of a sheet, the side edge extending along the conveying direction, the third guide surface extending to a downstream side of the guide in the conveying direction beyond the first area of the first guide surface.

5. The image forming apparatus according to claim 4, wherein the third guide surface is a planar surface inclined relative to the conveying direction, wherein at least a portion of the inclined planar surface of the third guide surface is disposed at a same position, in the conveying direction, as a portion of the inclined first area of the first guide surface.

6. The image forming apparatus according to claim 1, wherein the second area of the first guide surface is a curved surface.

7. The image forming apparatus according to claim 5, wherein no portion of the second area of the first guide surface overlaps the third guide surface in the vertical direction.

* * * * *